United States Patent [19]

Wilson et al.

[11] 4,424,024

[45] Jan. 3, 1984

[54] BULK CURING WITH SOLID FUEL

[75] Inventors: Robert W. Wilson, Charlotte; Olin C. Trull, Monroe, both of N.C.

[73] Assignee: Powell Manufacturing Company, Inc., Bennettsville, S.C.

[21] Appl. No.: 321,707

[22] Filed: Nov. 16, 1981

[51] Int. Cl.[3] ..... F27B 19/00

[52] U.S. Cl. ..... 432/90; 432/500; 122/15; 122/47; 122/51; 110/205

[58] Field of Search ..... 122/4 D, 13 R, 14, 15, 122/16, 17, 18, 19, 135 F, 136 R, 209 A, 47, 44 A, 38, 51; 110/205

[56] References Cited

U.S. PATENT DOCUMENTS

| | | | |
|---|---|---|---|
| 493,854 | 3/1893 | Bartlett | 122/209 A |
| 1,823,803 | 9/1931 | Leland | 122/136 R X |
| 2,082,289 | 6/1937 | Hodgin | 432/500 X |
| 2,286,206 | 6/1940 | Jackson | 432/500 X |
| 3,110,326 | 11/1963 | Hassler | 131/140 |
| 3,124,583 | 5/1964 | Wilson | 263/19 |
| 3,244,445 | 4/1966 | Wilson | 294/5.5 |
| 3,251,620 | 5/1966 | Hassler | 294/5.5 |
| 3,503,137 | 3/1970 | Wilson | 34/45 |
| 3,664,034 | 5/1972 | Wilson | 34/225 |
| 3,834,137 | 9/1974 | Long | 56/27.5 |
| 3,927,683 | 12/1975 | Wilson | 131/140 |
| 3,935,959 | 2/1976 | Long | 220/22 |
| 3,948,553 | 4/1976 | Suggs | 294/5.5 |
| 3,999,303 | 12/1976 | Martin | 432/500 X |
| 4,136,465 | 1/1979 | Wilson | 34/210 |
| 4,212,634 | 7/1980 | Mitchell et al. | 432/500 X |
| 4,242,972 | 1/1981 | Sicard | 110/205 X |
| 4,270,468 | 6/1981 | Robinson | 122/4 D |
| 4,303,198 | 12/1981 | Dulac | 122/15 X |
| 4,309,965 | 1/1982 | Hill | 122/136 R X |
| 4,321,758 | 3/1982 | Fowler | 432/500 X |

FOREIGN PATENT DOCUMENTS

| | | | |
|---|---|---|---|
| 55351 | 10/1938 | Denmark | 122/209.1 |
| 2444897 | 8/1980 | France | 122/13 R |
| 1540378 | 2/1979 | United Kingdom | 122/4 D |

OTHER PUBLICATIONS

Wood Curing Tobacco Can Provide Savings: Southeast Farm Press, Nov. 12, 1980.

Using Hot Water to Cure Tobacco: Rupert Watkins; The Flue Cured Tobacco Farmer, Jun. 1979.

Commercial Wood-Fired Barn Tested: Joe Gallehugh; Progressive Farmer, Dec. 1980.

Wood Heat Cut His Curing Bill by Half; Progressive Farmer, Jul. 1980.

Wood Makes the Grade as Leaf-Curing Fuel; Carolina Country, Aug. 1980.

Bulk Barns: Still Saving Money After All These Years; Carolina Country, May 1981.

Tobacco Grower Turns Back to Wood Curing: Southeast Farm Press, Oct. 8, 1980.

Program of the Tobacco Energy Conference, Virginia Polytechnic Institute and State University, Danville, Va., Feb. 24–25, 1981.

*Primary Examiner*—Henry C. Yuen

*Assistant Examiner*—David E. Helmbold

[57] ABSTRACT

Apparatus for bulk curing tobacco comprising a barn having a heat exchanger therein defining interior flow paths for heated water and exterior heat exchange surfaces disposed within the curing air flow path within the barn, hot water storage tank unit, a power operated pump for circulating hot water between the hot water storage tank unit and the heat exchanger, a hot water heating unit and a power driven pump for continuously circulating water between the hot water heating unit and the hot water storage unit. The hot water heating unit comprises an inner casing structure defining an interior combustion chamber, an outer casing structure extending over a portion of the exterior of the inner casing structure and defining therewith a water circulating space communicating with the continuous circulating pump, a grate assembly within the combustion chamber for supporting solid fuel for combustion therein, a forced draft blower for establishing a forced flow of combustion air into the combustion chamber, an induced draft blower for inducing a flow of combusted gases from the combustion chamber, and the operation of the blower being controlled to control the combustion rate of the supplied solid fuel and hence the amount of heat added to the water circulating in the water circulating space.

12 Claims, 8 Drawing Figures

BULK CURING WITH SOLID FUEL

This invention relates to tobacco curing and more particularly to improvements in bulk curing bright leaf, burley and other primed leaf tobacco.

Bulk curing as presently practiced is exemplified in commonly assigned U.S. Pat. Nos. 3,503,137; 3,664,034; 3,927,683; and 4,136,465. In all of these bulk systems curing is basically accomplished by establishing a forced flow of air upwardly through a series of dense leaf beds supported by leaf piercing tines and controlling the temperature and relative humidity of the forced flow of air in accordance with a predetermined schedule which includes the steps of yellowing the leaves, setting the color, drying the leaves and then bringing the leaves into order. Heretofore bulk curing units have included a forced air furnace unit which supplies the flow of heated curing air. The heating function is accomplished in the furnace unit either by an oil burner or by a gas burner.

In recent years the cost of both gas and oil has increased to the point that fuel expenses constitute a significant factor to the tobacco farmer in the economics of producing tobacco. Usually the tobacco farmer has readily available a cheap source of solid combustible material in the form of wood. In order to save costs there exists a need to provide a bulk curing system in which the heat is provided by burning solid fuel such as wood, coal, etc.

It is an object of the present invention to fulfill the aforesaid need. In accordance with the principles of the present invention this objective is obtained by replacing the oil or gas burner within the furnace unit of known bulk curing barns with a heat exchanger through which heated water can be passed. The air temperature of the curing air flowing through the furnace unit is controlled by pumping heated water from a heated water supply system which includes an insulated storage tank and a solid fuel burning water heater unit. Preferably, the arrangement is such that the heated water supply is sufficient to provide the heating requirements for two or more furnace units of two or more bulk curing barns.

The present invention is also characterized by improvements in the construction of the solid fuel burning water heater. The unit constructed in accordance with the principles of the present invention provides essentially a jacket of water surrounding a central wood burning grate which has means provided in cooperating relation therewith for supplying primary combustion air in a position beneath the grate and secondary combustion air in a position above the grate so as to assist in more complete combustion of the gases that are given off due to pyrolysis. The air handling system of the water heating unit which includes means for handling air for combustion and means for handling the combusted gases after combustion has taken place includes an inlet fresh air blower and an induced blower outlet for the products of combustion and a power operated damper for varying the amount of primary combustion air and/or secondary pyrolysis gases burning air, the combination of the control of the damper and control of the inlet blower and exhaust induced flow blower providing the required control both of the burning and of the heating of the water in the furnace unit necessary to accomplish the overall curing operation in which the heating requirements during different steps varies considerably. For example, it is well known that the drying steps require considerably greater amounts of heat than does the yellowing step. Accordingly it is another object of the present invention to provide improved solid fuel water heating unit which will meet the varying heat requirements needed in the bulk curing of tobacco.

Another object of the present invention is the provision of a water heating unit of the type described which is simple in construction, effective in operation and economical to manufacture and maintain.

These and other objects of the present invention will become more apparent during the course of the following detailed description and appended claims.

The invention may best be understood with reference to the accompanying drawings, wherein an illustrative embodiment is shown.

Figure 1:
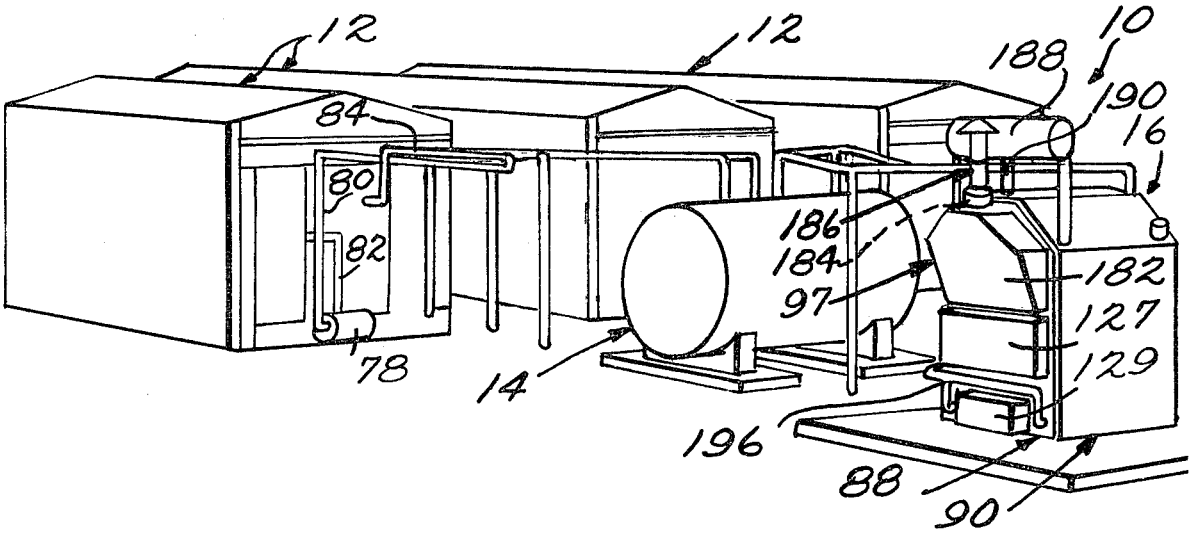
FIG. 1 is a perspective view illustrating the apparatus embodying the principles of the present invention.
Figure 2:
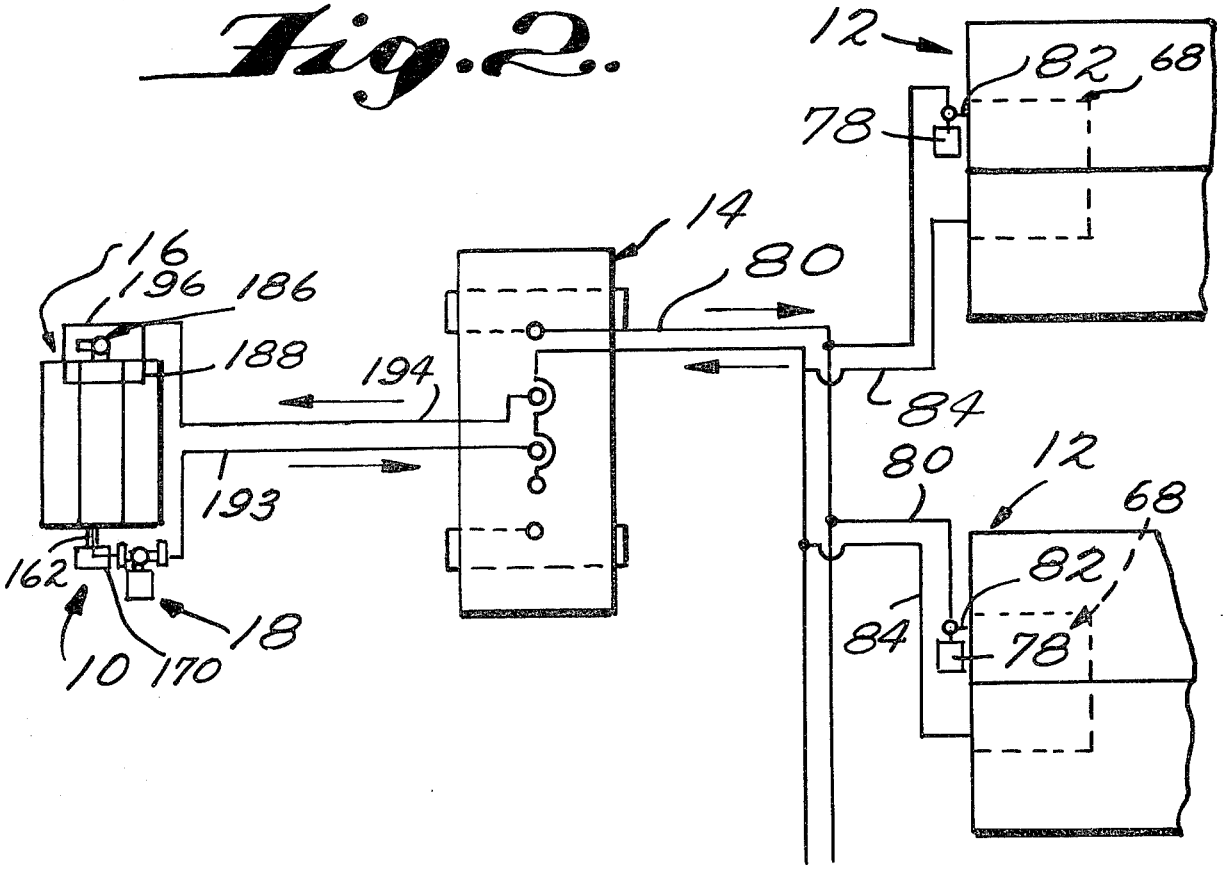
FIG. 2 is a schematic plan view illustrating the water flow diagram of the system.

Referring now more particularly to FIGS. 1 and 2 there is shown therein apparatus for bulk curing, generally indicated at 10, which embodies the principles of the present invention. The apparatus 10 is shown as including two bulk curing barn units, generally indicated at 12, although it will be understood that the present invention contemplates the utilization of a single barn or more than two as an operating part of the apparatus. The apparatus 10 also includes an insulated hot water storage unit, generally indicated at 14, and a solid fuel burning hot water heater unit, generally indicated at 16. The hot water heater unit 16 is connected with the insulated storage tank unit 14 by suitable piping within which is embodied a circulation pump 18 which serves to continuously circulate water between the solid fuel water heater unit 16 and the storage tank unit 14.

Figure 3:
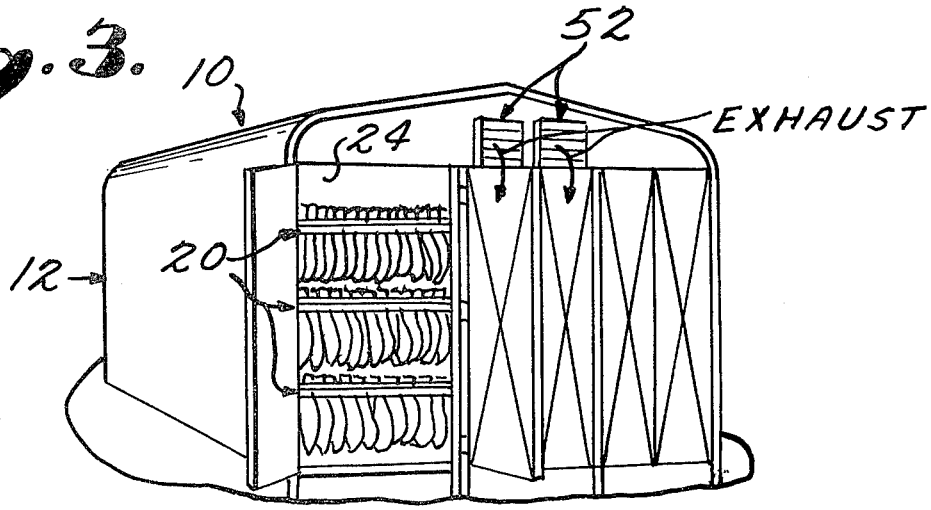
FIG. 3 is a front perspective view of a bulk curing barn unit utilized as part of the apparatus of the present invention.
Figure 4:
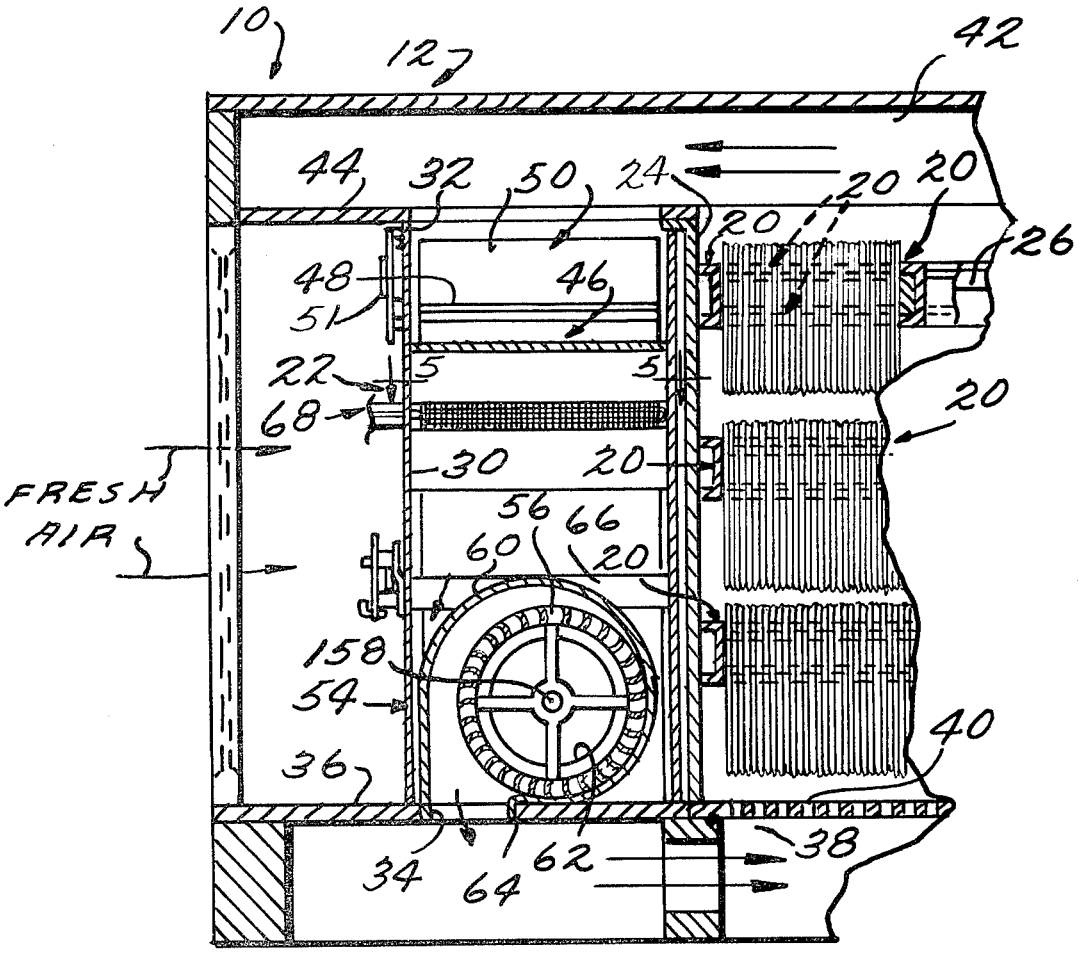
FIG. 4 is an enlarged fragmentary sectional view through the rear end portion of the barn unit shown in FIG. 3.

Referring now more particularly to FIGS. 3 and 4, there is shown therein a section of one of the bulk curing barn units 12 illustrating the improvements embodied therein in accordance with the principles of the present invention. The bulk curing barn unit 12 shown is of the rack type disclosed in commonly assigned U.S. Pat. Nos. 3,251,620; 3,503,137; 3,664,034; and 3,927,683, the disclosures of which are hereby incorporated by reference into the present specification. It will be understood, however, that the invention is applicable to other curing barn units in which the leaves are handled in batches substantially larger than the batch handled within a single rack. An example of a larger bulk batch system is disclosed in U.S. Pat. No. 4,136,465, the disclosure of which is hereby incorporated by reference into the present specification. It will also be understood that the present invention is applicable to other rack arrangements and big batch arrangements such as, for example, disclosed in U.S. Pat. Nos. 3,834,137; 3,935,959; and 3,948,553. As indicated, for purposes of illustrating the improvements of the present invention, the manner in which they are embodied within a conventional rack barn unit 12 will be described herein.

As shown in the drawings, each rack barn unit 12 is adapted to receive and support a plurality of bulk curing racks, generally indicated at 20, constructed in accordance with the teachings of commonly assigned U.S. Pat. No. 3,244,445, dated Apr. 5, 1966, the disclosure of which is hereby incorporated by reference into the present specification. As stated in the aforesaid Wilson and Hassler patents, each of the bulk curing racks 20 is operable to support a multiplicity of tobacco leaves within the barn unit 12 for curing by the passage of curing air vertically therethrough.

As best shown in FIGS. 3 and 4, each barn unit 12 includes a curing air conditioning and circulating assembly, generally indicated at 22. In general, the assembly 22 is operable to establish a forced flow of heated air upwardly through the leaves carried by the bulk curing racks within the curing barn unit 12 to effect cure of the leaves.

The principles of the present invention can be adequately understood without a description of the details of the curing barn unit 12. Reference may be had to the aforesaid Hassler U.S. Pat. No. 3,110,326, and Wilson U.S. Pat. No. 3,134,583, for these details. For present purposes, it is important merely to note that the curing barn structure provides one or more curing compartments 24. Each of the curing compartments 24 is provided with rack supporting rails 26 which, as best shown in FIG. 4, are disposed on three vertically spaced, horizontally aligned pairs on opposite sides of each compartment. The curing compartments define a tobacco loading and curing space through which the curing air passes vertically upwardly. Each horizontally aligned pair of rails 26 slidably receives and supports a plurality of bulk curing racks 20. The racks are of a size complementary to the curing chambers 24 so that when a plurality of such racks is supported on the rails 26 within each curing compartment 24 the leaves to be cured are supported for curing in three vertically spaced compact beds of leaves which uniformly fill the curing compartment in such a way as to insure that the curing air will pass through the leaves of the beds in series.

The curing air conditioning and circulating assembly 22 is operable to provide effective control of the rate of air flow through the tobacco supported by the racks 20 within the compartments 24 during the curing process. The assembly 22 comprises certain known components including a vertically extending main housing 30 of conventional skeletonized frame and sheet metal construction and forming a part of an endless circulatory curing air flow path which, for convenience, can be described as commencing with an inlet opening 32 defined by the upper end of the housing 30 and extends therefrom in the direction of flow downwardly through the housing 30 to a discharge or outlet opening 34 formed in an imperforate floor structure 36. From the discharge opening 34 the air flows into an inlet space 38 which communicates with the curing compartments through perforated floor structures, generally indicated at 40.

The floor structures define the lower surface of the tobacco loading compartments through which the curing air flows vertically upwardly. The upper end of the curing compartments freely communicates with an upper return air space 42 defined along its upper surface by the roof of the barn structure. The endless curing air flow path is completed by communicating the upper space 42 with the upper inlet opening 32 of the housing 30 as by a roof structure 44.

In order to control the relative humidity of the curing air, the housing 30 is formed with fresh air inlet means 48 which, as shown, is in the form of two rectangular openings, one on each side of the housing adjacent the upper end thereof. The amount of fresh air introduced into the flow path is controlled by a damper member 50 movably mounted within each fresh air inlet opening 48, the two dampers being interconnected for movement together by a lever and connecting rod assembly 51 of generally conventional construction. When the damper members 50 are adjusted to permit the introduction of fresh air through the inlet openings 48 additional air is supplied to the system and, for the purpose of permitting the discharge of a generally corresponding amount of air from the circulatory path, there is provided a pair of louvre units 52 which forms a part of the overall damper means for controlling the introduction and exhaust of air into and out of the circulatory path of flow. It will be understood that the fresh air inlet damper means may be automatically operated as, for example, by the control mechanism disclosed in commonly assigned U.S. Pat. No. 3,503,137, dated Mar. 31, 1970, as well as other types of automatic as well as semi-automatic control mechanisms known in the art.

The circulation of curing air within the flow path is provided by a rotatable fan or blower, generally indicated at 54, mounted within the housing 30 with its suction side downstream from the fresh air inlet openings 48. As shown, the fan or blower is of the squirrel cage type, having a rotor blade assembly 56 mounted on a horizontal shaft 58 suitably journaled within the housing 30 surrounded by a casing 60 providing axial inlet openings 62 spaced from the adjacent wall of the housing 30 and a generally tangential outlet 64 connected with the outlet openings 34 in the floor structure 36.

The curing air controlling and circulating assembly 22 is preferably provided with damper members 66 for throttling the rate of air flow established by the fan 54, in accordance with the teachings of U.S. Pat. No. 3,664,034.

The temperature of the curing air is controlled by means of a heat exchanger, generally indicated at 68, which is mounted within the housing 30 of the assembly 22 in a position between the fresh air inlet dampers 50 and the throttling damper members 66. The heat exchanger 68 is provided in lieu of the gas or oil burner unit provided in the prior art arrangements such as disclosed in the aforesaid commonly assigned patents. The heat exchanger 68 may be of any known configuration, an exemplary embodiment being the Aerofin Heat Exchanger Model 30 TF-44-5/16", manufactured by Aerofin Corporation of Lynchburg, Va. Such a unit includes a rectangularly shaped peripheral frame 70 suitable for mounting within the interior of the housing 30 having a multiplicity of finned U-shaped tubes 72 extending across the interior thereof. One end of each U-shaped tube 72 communicates with an inlet manifold 74, while the other end of each tube communicates with an outlet manifold 76. The legs of the U-shaped tubes have their axes extending horizontally but in spaced relation both horizontally and vertically so as to be presented most effectively within the flow of air within the housing 30.

As shown, there is associated with each heat exchanger 68 an electric motor-pump unit 78, the suction side of which is communicated with the storage tank 14 through a pipe 80 and the pressure side of which communicates with the inlet manifold 74 through a pipe 82. When the electric motor is energized to drive the pump of the unit 78, hot water is circulated from the insulated storage tank unit 14 through the associated heat exchanger 68 and returned to the insulated storage tank unit 14 as by a return pipe 84 communicating at one end with the outlet manifold 76 of the associated heat exchanger 68 and at its opposite end with the storage tank.

The storage tank unit 14 may be of any suitable construction. As schematically illustrated in FIG. 2, it consists of an enlarged cylindrical steel tank having a layer of insulating material such as foam plastic adhered to the exterior periphery thereof. It will be understood that the cylindrical steel-foam plastic insulated water storage unit is merely exemplary.

Figure 6:
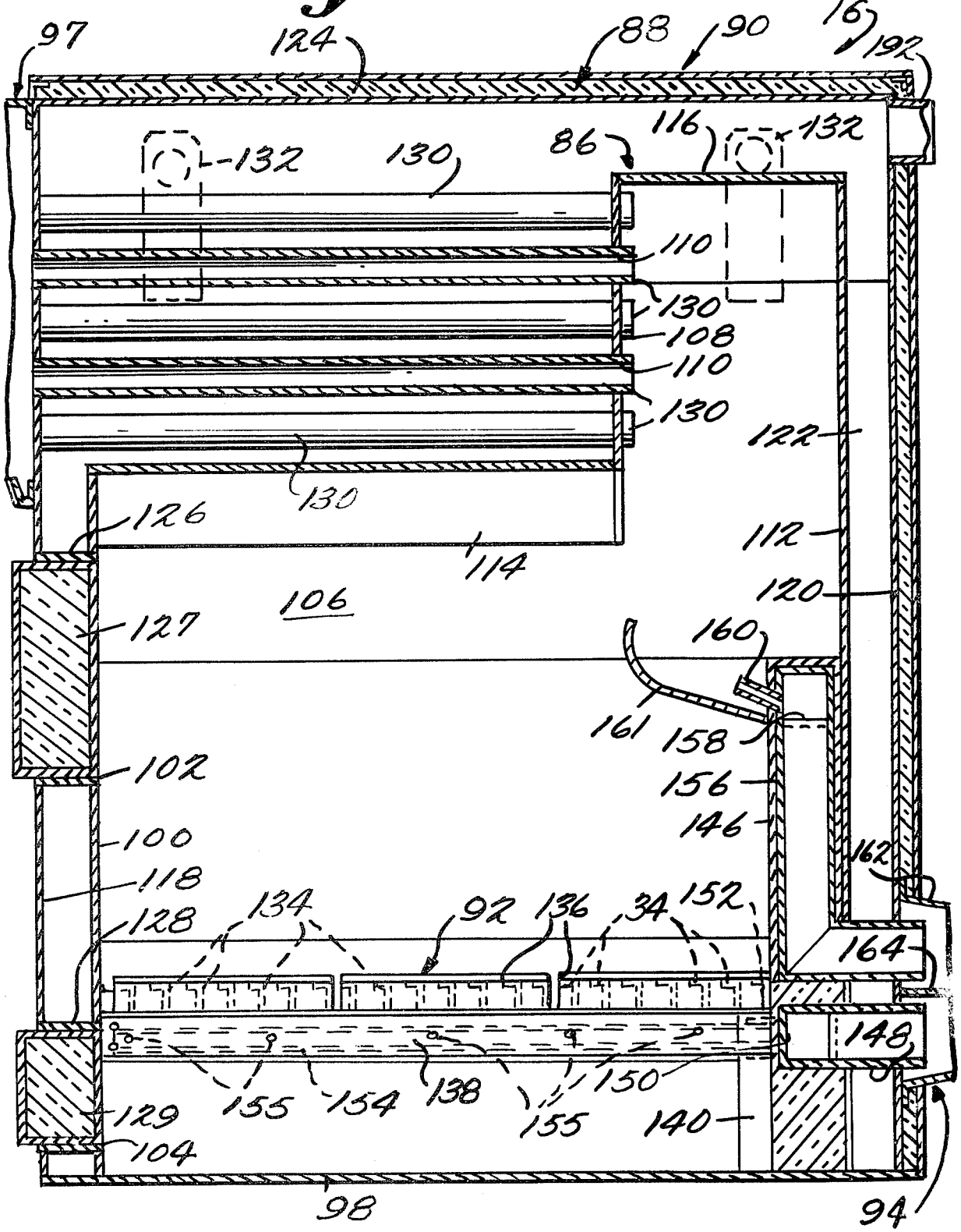
FIG. 6 is a longitudinal sectional view of the hot water heating unit embodying the principles of the present invention.
Figure 7:
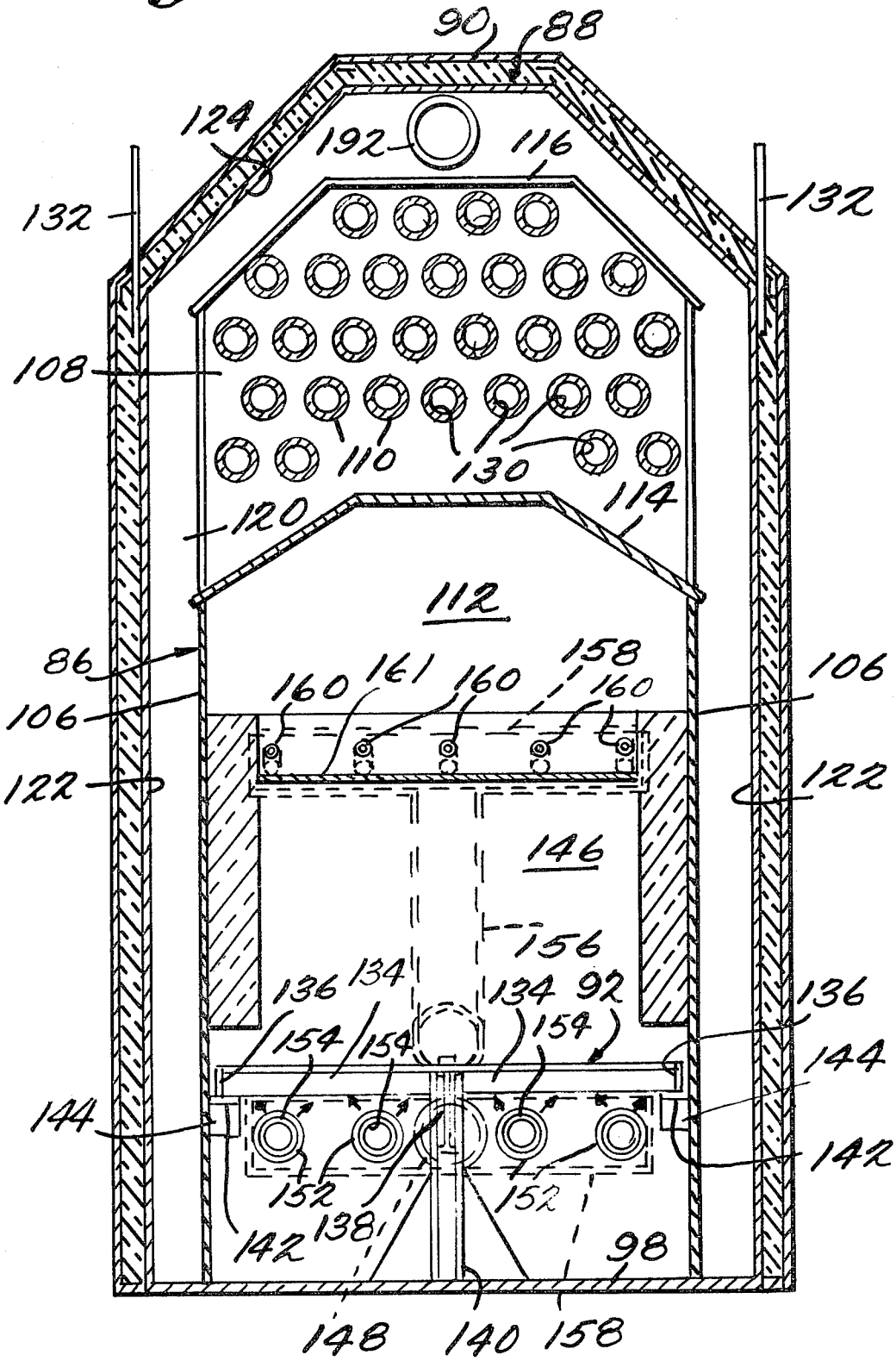
FIG. 7 is a cross-sectional view taken along the line 7—7 of FIG. 6.

Referring now more particularly to FIGS. 6 and 7 of the drawings, the hot water heater unit 16 is constructed of an inner casing structure, generally indicated at 86, which defines the combustion chamber within which the solid fuel such as wood is burned, an outer casing structure, generally indicated at 88, which cooperates with the inner casing structure to define a water circulating space substantially surrounding the combustion chamber and an insulating outer cover assembly, generally indicated at 90, which substantially surrounds the exterior of the outer casing structure. Mounted within the combustion chamber is a fuel grate assembly, generally indicated at 92, which serves to support solid fuel for burning within the combustion chamber. Mounted within the combustion chamber in operative relation with the grate assembly 92 is a power controlled combustion air blower assembly, generally indicated at 94. Finally, the unit 16 includes a combusted air induced draft exhaust assembly, generally indicated at 97.

The inner casing structure 86 includes a bottom plate 98 which is common to both the outer casing structure 88 and the outer cover assembly 90. The inner casing structure also includes a front wall 100 fixed at its lower edge to the bottom plate 98 and extending upwardly therefrom at right angles. Formed in the upper portion of the front wall 100 is a solid fuel receiving opening 102 of rectangular configuration. A smaller ashes removal opening 104 of rectangular configuration is formed in the lower portion of the front wall 100. Extending rearwardly from the side edges of the front wall 100 is a pair of side walls 106 of generally L-shaped configuration providing an upward extension at the rearward portion of the combustion chamber. The upper extension includes a front wall section 108 having a series of circular openings 110 formed therein. The inner casing structure 86 is completed by the provision of a rear wall 112 and two dual pitched top walls 114 and 116, the latter extending over the upper rearward extension of the combustion chamber and the former extending over the remaining portion extending forwardly thereof.

The outer casing structure 88 includes front and rear walls 118 and 120 of similar peripheral configuration. The configuration is similar to the configuration of the rear wall 112 of the inner casing structure except that the side edges extend outwardly beyond the side edges of the rear wall 112 and the top edges extend upwardly beyond the top edges of the rear wall 112. The front and rear walls 118 and 120 are rigidly interconnected by a pair of side walls 122 and appropriate top wall sections 124. It will be noted that the front wall 118 of the outer casing structure is provided with rectangular openings registering with the openings 102 and 104 in the front wall 100 of the inner casing structure. A peripheral frame 126 is mounted within the opening 102 of the inner casing front wall 100 and the registering opening of the outer casing front wall so as to define the opening for the feeding of solid fuel into the combustion chamber. The solid fuel opening is selectively closed by a door 127 suitably hinged and latched to the peripheral frame 126. Similarly, a peripheral frame 128 is mounted within the opening 104 of the inner casing front wall and the registering opening of the outer casing front wall 118. This frame serves to define the opening for removal of ashes from the combustion chamber. As before, this opening is selectively closed by a door 129 suitably hinged and latched to the peripheral frame 128.

It will also be noted that the outer casing front wall 118 has a series of circular openings formed therein which correspond and register with the openings 110 formed in the upper front wall section 108 of the inner casing structure. A multiplicity of horizontally extending combusted air exhaust tubes 130 are fixed at one end within the openings 110 and at their opposite ends with the registering openings within the outer casing front wall 118. It will be noted that except for the common connection of the outer casing structure and the inner casing structure with the bottom wall 98, the outer casing structure extends in spaced relation throughout the remaining exterior surface of the inner casing structure. This space constitutes a water circulation space or jacket for the flow of water through the unit 16 so as to pick up heat from the solid fuel combustion carried out within the combustion chamber provided by the interior of the inner casing. It will also be noted that exhaust tubes 130 extend through this water circulation space so as to materially aid in transferring the heat from the combusted solid fuel to the water.

In order to provide for the effective handling of the unit 116, four apertured lugs or plates 132 are welded to the upper marginal edges of the side walls 122 of the outer casing structure 88. These plates are adapted to extend through the outer cover assembly 90 so as to permit hooks to enter the apertures in the lugs and enable the unit to be handled as by a crane or the like.

The outer cover assembly constitutes essentially of an insulating cover for the side, rear and top walls of the outer casing structure and may assume any desired construction. In the embodiment shown, the edges of the outer cover assembly are defined by angle irons welded to the associated outer casing structure in spaced relation thereto by a series of spacer plates. A skin of sheet metal extends between the exterior surfaces of the angle irons and panels of insulating material are mounted between the interior surface of the sheet metal skin and the associated exterior surface of the outer casing structure.

The fuel grate 92 is of conventional construction and sized to accommodate a particular solid fuel as, for example, coal, wood or the like. As shown, the grate assembly consists essentially of three grate sections, each of which is formed of a plurality of cross members 134 of inverted L-shaped cross-sectional configuration secured together in spaced parallel relation by transversely extending bars 136. The grate sections are supported within the combustion chamber in spaced relation above the bottom plate 98 along their central lower surfaces by an I-beam 138. The forward end of the I-beam 138 is suitably welded to the interior surface of the inner casing front wall 100 and the rearward end has a leg structure 140 fixed thereto which is also secured to the bottom plate 98. The grate sections are supported along their side edges by metal straps or ledges 142 having a series of vertical plates 144 fixed thereto in depending relation. The straps 142 and plates 144 are suitably welded to the interior surfaces of the side walls 106.

The power controlled combustion air blower assembly 94 includes a rear refractory barrier 146 which is mounted within the combustion chamber against the interior surface of the lower portion of the inner casing rear wall 112. The refractory barrier 146 preferably extends into abutting relation between the interior casing side walls 106 and may assume any desirable construction such as brick, cinder block, concrete or other similar refractory material. Similar side refractory barriers 147 are preferably also provided on the interior surfaces of the side walls 106 at positions above the grate assembly 92. Extending exteriorly through the outer cover assembly, outer casing rear wall 120 and inner casing rear wall 112 and into the rear refractory barrier wall 146, is a primary combustion air inlet conduit or pipe 148. Extending horizontally within the refractory barrier 146 is a primary air manifold conduit 150 which communicates at its central rearward portion with the forward end of the inlet conduit 148 and has a plurality of sleeves 152 extending from the forward portion thereof through the refractory barrier 146. As shown there are four sleeves 152 mounted in horizontally spaced relation at a position below the grate assembly 92 between the I-beam 138 and side straps 142. Each sleeve 152 has connected therewith an elongated combustion air distributing tube 154. The forward end of each tube extends to the forward end of the grate assembly 92 and is suitably plugged and each tube has formed in the upper portion thereof a series of cylindrical outlet openings 155 for directing air upwardly through the grate assembly 92 which is disposed thereabove. The series of outlet openings 155 are disposed in two rows, with the axes of the openings in the rows being spaced along planes displaced angularly about the axis of the tube 45° on opposite sides of a vertical plane passing through the axis.

The power controlled combustion air blower assembly 94 also includes a secondary air duct or tube 156 which is positioned in parallel relation above the primary air conduit 148 so as to extend exteriorly through the outer cover assembly 90, the outer casing rear wall 120, the inner casing rear wall 112 and into the refractory barrier 146. The conduit 156 is generally L-shaped in configuration and its vertical leg extends within the central portion of the refractory barrier 146 into communication with a secondary combustion air manifold conduit 158. Extending forwardly and upwardly from the forward portion of the manifold conduit 158 is a plurality of secondary air outlet tubes 160. As best shown in FIG. 6, the tubes 160 are disposed in spaced horizontal relation with respect to one another so as to discharge air therefrom generally forwardly. A baffle plate 161 is supported by the refractory barrier 146 and extends outwardly therefrom in a position below the tubes 160. The baffle extends beyond the discharge end of the tubes and is curved upwardly so as to deflect the generally forwardly directed air issuing from the discharge tubes 160 in an upward direction toward the combustion chamber space defined by the rearward upper extension of the inner casing structure 86.

The power controlled combustion air blower assembly 94 further includes an inlet duct structure 162 which is fixed in a position surrounding the rearward open ends of the primary and secondary air inlet conduits 148 and 156. As shown, the inlet duct structure 162 is of welded sheet metal construction having a rectangular interior cross-sectional configuration which progressively increases from the rearward end thereof to the forward end which encompasses the rearward ends of the air inlet conduits 148 and 156. Mounted in the forward end of the inlet duct 146 in a position between the air conduits 148 and 156 is a divider plate 164. Disposed along the rearward edge of the divider plate 164 is a shaft 166 the ends of which extend through and are journaled on the associated side walls of the inlet duct 162. A damper plate 168 is fixed to the shaft 166 between the side walls of the duct so as to be moved therein in response to the pivotal movement of the shaft 166. The radial extent of the damper plate 168 is such that the outer edge thereof is capable of engaging either the lower wall of the duct or the upper wall of the duct in response to corresponding pivotal movement of the shaft 166. It can thus be seen that the position of the damper plate 166 controls the proportionate amount of air which is allowed to enter the space below the divider plate 164 and into the primary air conduit 148 and the space above the divider plate 164 and into secondary air conduit 156. The rearward end of the inlet duct 162 is connected with the outlet of a motor driven blower 170.

Figure 8:
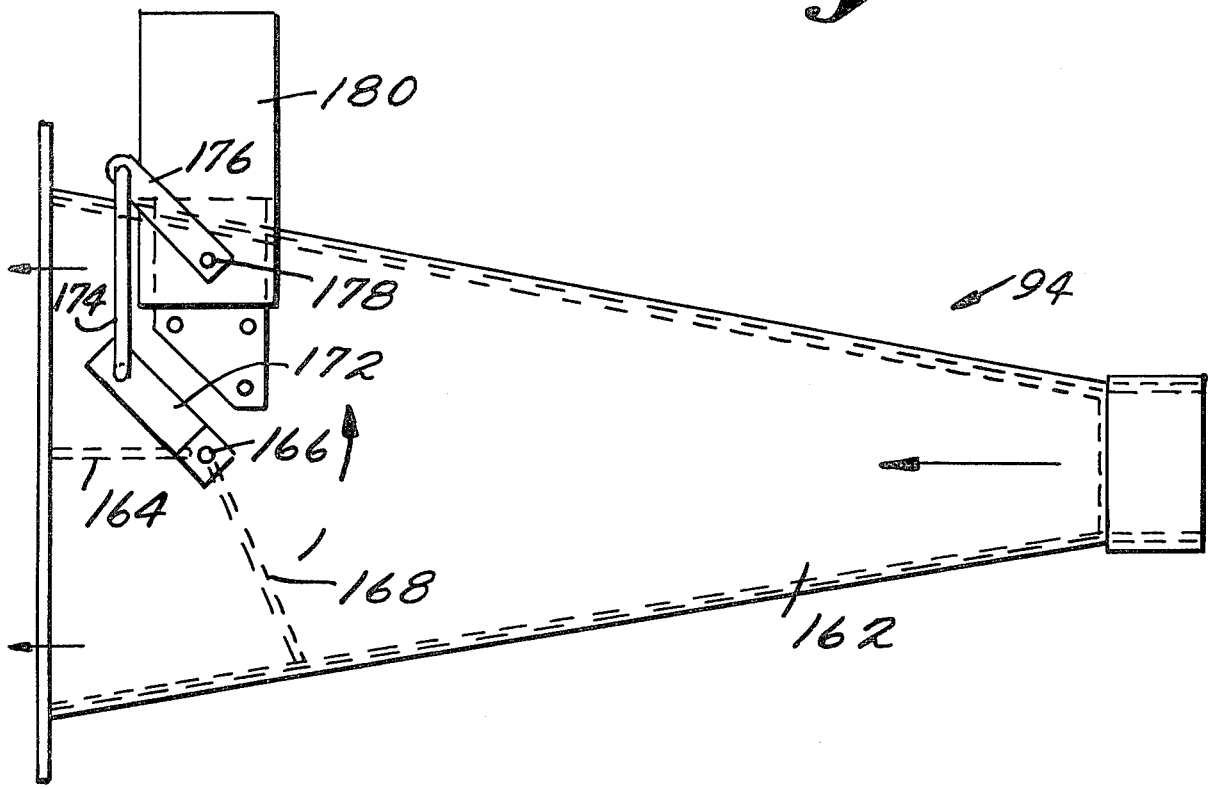
FIG. 8 is an enlarged fragmentary sectional view of the power controlled forced draft combustion air blower assembly.
Figure 5:
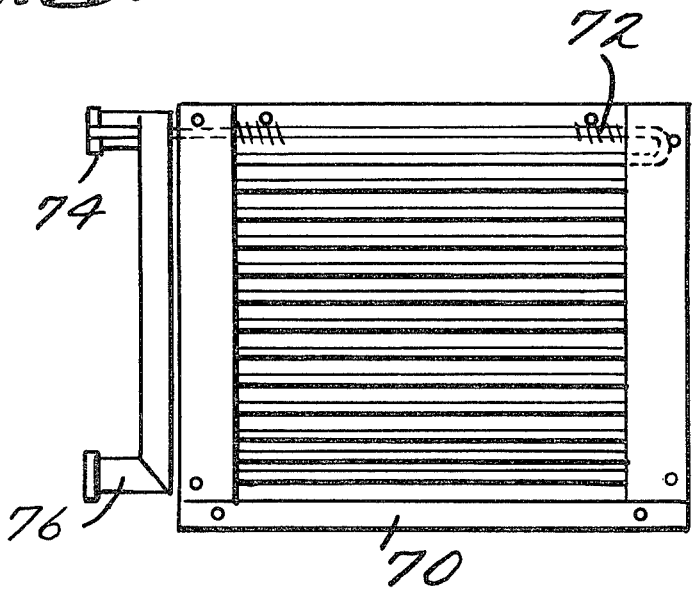
FIG. 5 is an enlarged fragmentary sectional view taken along the line 5—5 of FIG. 4.

As best shown in FIG. 8, one end of the shaft 166 which extends outwardly beyond an associated one of the side walls of the inlet duct 162 has fixed thereto one end of an actuating arm 172, the other end of which is apertured to receive one end of a connecting rod 174 and the other end of which is pivotally connected with one end of a motor actuating arm 176. As shown, arm 176 is fixed to a geared down output shaft 178 driven by an electric motor 180 suitably fixedly mounted on the inlet duct 162.

The induced draft combusted air exhaust assembly 96 includes a manifold duct structure 182 mounted on the exterior surface of the upper portion of the outer casing front wall 118 in surrounding relation to the open end of the exhaust tubes 130 extending therethrough. The exhaust tubes may be regarded as a part of the combusted air exhaust assembly 97 together with the exhaust manifold duct 182. The latter receives combusted air passing through all of the tubes 130 and directs the same upwardly through an upwardly extending tubular section 184. Preferably the front plate of the exhaust manifold duct is removable to permit convenient cleaning of the interior of the tubes 130 to remove soot and other deposits therefrom. An induced draft blower assembly 186 is mounted on the section 184 which when operated induces a flow of combusted gases from the combustion chamber. Induced draft blower assembly 186 is somewhat schematically illustrated in the drawings and preferably constitutes a commercially available unit of this type. An exemplary embodiment is the unit manufactured and sold by Quickdraft Corporation.

While it is within the contemplation of the present invention to operate the hot water storage tank unit 14 in a less-than-full condition (in which case the circulation pump 18 would be connected thereto at its suction side), it is preferred to operate the hot water tank 14 full and to provide for the expansion of water due to temperature changes by means of an expansion tank 188 which is mounted in a position above the hot water heater unit 16 (e.g. four feet). As shown, the tank 188 is communicated with the water space in the hot water heater unit 16 by a vertical pipe 190 which extends through the top wall of the cover assembly 90 and the associated top wall of the outer casing structure 88. If desired, the expansion tank may be provided with a float valve (not shown) for controlling the introduction of a water source therein so as to prevent the system from draining to a point where the creation of steam could be a factor. With the preferred arrangement, the suction side of the circulation pump 18 is communicated with the water space within the unit 16 as by a pipe 192. As best shown in FIG. 7, the pipe 192 is communicated with the water circulation space at a position adjacent the upper end of the rear wall 120 of the outer casing structure 88. As best shown in FIG. 2, the pressure side of the pump 18 is connected with a pipe 193 which leads to the hot water storage tank unit 14. A return line 194 extending from the hot water storage tank unit 14 is branched, as indicated at 196, so as to communicate with the water circulating space within the unit 16 at two positions adjacent the lower sides of the front wall 118 of the outer casing structure 88.

In operation, each curing barn unit 12 is operated in accordance with the disclosures set forth in the aforesaid commonly assigned U.S. patents, except instead of an oil or gas burner being ignited in response to the temperature signals indicated, the motor of the associated motor-pump unit 78 is actuated so as to cause heated water to circulate through the associated heat exchanger 68. The temperature of the water circulated through the heat exchanger 68 associated with each barn unit 12 is determined by the operation of the units 14 and 16 in conjunction with the circulating pump 18. This temperature can vary in accordance with the particular needs. A typical example is a temperature between 160° and 190°. As indicated, the heating requirements during the yellowing stage of the cure are considerably less than those required in the drying stages.

In the initial operation of the hot water heater unit 16, the motor 180 is operated to move the damper plate 168 into a generally horizontally extending position which serves to divide the forced flow of air from the blower 170 generally equally to the primary air inlet conduit 148 and the secondary air inlet conduit 156. In addition both the forced draft combustion air blower 170 and induced draft exhaust blower assembly 186 are energized so that there exists maximum combustion air within the combustion chamber to support burning of the supply of solid fuel on the grate assembly 92. As the temperature of the water which is continuously circulated through the circulating space within the unit 16 reaches a predetermined threshold value, as for example 200°, a thermostatic control (not shown) operated in response to a temperature sensor for the water within the circulating space of unit 16 is operable to energize the damper motor 180 so as to move the damper plate 168 into a position closing off flow of combustion air to the primary air inlet conduit 148. This has the effect of reducing the rate of combustion of the solid fuel on the grate assembly 92. When the thermostat reaches a temperature of 211° as determined by the aforesaid temperature probe in the water space of the unit 16, the thermostat is operable to turn off both blowers 170 and 186, a procedure which has the effect of cutting off the flow of combustion air to the solid fuel burning on the grate assembly 92. In this way the solid fuel is left to smolder until the water temperature is reduced to a point suitable to turn on the blowers and energize the motor 180 to permit primary air to be introduced.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. Apparatus for bulk curing tobacco comprising a barn structure having means defining a path for the circulation of air including curing compartment means within said path, leaf piercing tine means for supporting a multiplicity of tobacco leaves in initally compressed bulk form within said curing compartment means for curing by contact with the air circulating in said path, fan means within said path for establishing and maintaining a forced circulating flow of air in said path in contact with tobacco leaves supported therein, damper means within said path for controlling the introduction of outside air into said path to be circulated therein and the discharge of circulating air from said path to the atmosphere to thereby vary the relative humidity of the circulating air contacting the tobacco leaves supported within said curing compartment means, and heating means within said path for applying heat to the air circulated in said path to thereby vary the temperature of the circulating air contacting the tobacco leaves supported within said curing compartment means, the improvement which comprises said heating means comprising heat exchanger means defining interior flow path means for heated water and exterior heat exchange surface means within said air flow path, hot water supply means, and power operated pump means for circulating hot water between said hot water supply means and said heat exchanger means, said hot water supply means including a hot water heating unit, a hot water storage unit and means for continuously circulating water between said hot water heating unit and said hot water storage unit, said hot water heating unit comprising an inner casing structure defining an interior combustion chamber, an outer casing structure extending over a portion of the exterior of said inner casing structure and defining with said exterior portion of said inner structure a water circulating space communicating with said continuous circulating means, a grate assembly within said combustion chamber for supporting solid fuel for combustion therein, exterior door means leading to said combustion chamber for supplying solid fuel into said combustion chamber in supported relation to said grate assembly and for removing ashes from said combustion chamber, forced draft blower means for establishing a forced flow of combustion air into said combustion chamber, said forced draft blower means comprising primary combustion air conduit means extending beneath said grate assembly for providing combustion air to the solid fuel supported thereabove on said grate assembly, separate secondary air conduit means extending above said grate assembly for providing combustion air for the pyrolysis gases produced by the burning solid fuel supported on said grate assembly, power operated blower means for delivering a supply of combustion air to said primary and secondary air conduit means and means for varying the proportion of the supply of combustion air delivered to said primary air conduit means in relation to said secondary air conduit means, induced draft blower means for inducing a flow of combusted gases from said combustion chamber, and means for controlling the operation of said blower means so as to control the combustion rate of the supplied solid fuel and hence the amount of heat added to the water circulating in said water circulating space.

2. Apparatus as defined in claim 1 wherein said forced draft blower means includes an upstanding refractory barrier within said combustion chamber adjacent said grate assembly, said primary combustion air conduit means and said secondary air conduit means extend exteriorly through said refractory barrier, said combustion air delivery varying means comprising a power operated damper assembly.

3. Apparatus as defined in claim 2 wherein said primary air conduit means includes a primary air manifold conduit within said refractory barrier, a primary air inlet conduit communicating with said primary air manifold conduit, and a plurality of elongated primary air discharge pipes extending horizontally from said primary air manifold conduit in horizontally spaced relation with respect to one another beneath said grate assembly, each of said primary air discharge tubes having a series of spaced openings extending upwardly therein for directing the forced flow of combustion air through said grate assembly in jets creating a turbulent condition which enhances burning.

4. Apparatus as defined in claim 2 or 3 wherein said secondary conduit means includes a secondary air manifold within said refractory barrier in a position above said primary air manifold, a secondary air inlet conduit communicating with said secondary air manifold, and a plurality of secondary air discharge tubes extending from said secondary air manifold conduit operable to discharge the forced flow of combustion air in a position above the rear portion of said grate assembly in a direction generally toward the forward portion thereof, and baffle means for directing the generally forwardly directed flow from said secondary air discharge tubes in a generally upward direction.

5. Apparatus as defined in claim 4 wherein said induced draft blower means includes a multiplicity of combusted air discharge tubes extending through said water circulating space, the interior of said tubes communicating at one of their ends with said combustion chamber to receive combusted gases therein, a manifold duct receiving combusted air from the other ends of said tubes and power operated blower means mounted with its discharge in flow inducing relation with respect to said manifold duct.

6. Apparatus as defined in claim 1, 2 or 3 wherein said induced draft blower means includes a multiplicity of combusted air discharge tubes extending through said water circulating space, the interior of said tubes communicating at one of their ends with said combustion chamber to receive combusted gases therein, a manifold duct receiving combusted air from the other ends of said tubes and power operated blower means mounted with its discharge in flow inducing relation with respect to said manifold duct.

7. Apparatus as defined in claim 1, 2 or 3 wherein an expansion tank is mounted at a vertical level above said hot water heating unit and said hot water storage unit, said expansion tank being communicated with said hot water storage unit such that any expansion in the volume of water in said hot water storage unit is taken up in said expansion tank.

8. Apparatus for establishing and maintaining a controlled flow of air through a multiplicity of tobacco leaves or the like supported in a curing structure comprising a housing having an inlet adapted to be communicated with the interior of the curing structure, an outlet adapted to be communicated with the interior of the curing structure, and means defining a path of air flow from said inlet to said outlet, fan means carried by said housing with said path for establishing and maintaining a forced flow of air from said inlet through said path and out said outlet for passage into the interior of the curing structure and through the tobacco leaves supported therein, damper means carried by said housing in communication with said path movable to control the introduction of outside air into said path to thereby vary the relative humidity of the flowing air contacting the tobacco leaves supported within the barn, and heating means carried by said housing within said path for applying heat to the air in said path to thereby vary the temperture of the flowing air contacting the tobacco leaves supported within the barn, the improvement which comprises said heating means comprising heat exchanger means defining interior flow path means for heated water and exterior heat exchange surface means within said air flow path, hot water supply means, and power operated pump means for circulating hot water between said hot water supply means and said heat exchanger means, said hot water supply means including a hot water heating unit, a hot water storage unit and means for continuously circulating water between said hot water heating unit and said hot water storage unit, said hot water heating unit comprising an inner casing structure defining an interior combustion chamber, an outer casing structure extending over a portion of the exterior of said inner casing structure and defining with said exterior portion of said inner structure a water circulating space communicating with said continuous circulating means, a grate assembly within said combustion chamber for supporting solid fuel for combustion therein, exterior door means leading to said combustion chamber for supplying solid fuel into said combustion chamber in supported relation to said grate assembly and for removing ashes from said combustion chamber, forced draft blower means for establishing a forced flow of combustion air into said combustion chamber, said forced draft blower means comprising primary combustion air conduit means extending beneath said grate assembly for providing combustion air to the solid fuel supported thereabove on said grate assembly, separate secondary air conduit means extending above said grate assembly for providing combustion air for the pyrolysis gases produced by the burning solid fuel supported on said grate assembly, power operated blower means for delivering a supply of combustion air to said primary and secondary air conduit means and means for varying the proportion of the supply of combustion air delivered to said primary air conduit means in relation to said secondary air conduit means, induced draft blower means for inducing a flow of combusted gases from said combustion chamber, and means for controlling the operation of said blower means so as to control the combustion rate of the supplied solid fuel and hence the amount of heat added to the water circulating in said water circulating space.

9. Apparatus as defined in claim 8 wherein said forced draft blower means includes an upstanding refractory barrier within said combustion chamber adjacent said grate assembly, said primary combustion air conduit means and said secondary air conduit means extend exteriorly through said refractory barrier, said combustion air delivery varying means comprising a power operated damper assembly.

10. Apparatus as defined in claim 9 wherein said primary air conduit means includes a primary air manifold conduit within said refractory barrier, a primary air inlet conduit communicating with said primary air manifold conduit, and a plurality of elongated primary air discharge pipes extending horizontally from said primary air manifold conduit in horizontally spaced relation with respect to one another beneath said grate assembly, each of said primary air discharge tubes having a series of spaced openings extending upwardly therein for directing the forced flow of combustion air through said grate assembly in jets creating a turbulent condition which enhances burning.

11. Apparatus as defined in claim 8 or 9 wherein said secondary conduit means includes a secondary air manifold within said refractory barrier in a position above said primary air manifold, a secondary air inlet conduit communicating with said secondary air manifold, and a plurality of secondary air discharge tubes extending from said secondary air manifold conduit operable to discharge the forced flow of combustion air in a position above the rear portion of said grate assembly in a direction generally toward the forward portion thereof, and baffle means for directing the generally forwardly directed flow from said secondary air discharge tubes in a generally upward direction.

12. Apparatus as defined in claim 11 wherein said induced draft blower means includes a multiplicity of combusted air discharge tubes extending through said water circulating space, the interior of said tubes communicating at one of their ends with said combustion chamber to receive combusted gases therein, a manifold duct receiving combusted air from the other ends of said tubes and power operated blower means mounted with its discharge in flow inducing relation with respect to said manifold duct.

* * * * *